US005165807A

United States Patent [19]

Kanemoto

[11] Patent Number: 5,165,807

[45] Date of Patent: Nov. 24, 1992

[54] PRINTING HEAD HAVING A DISTORTION ELEMENT

[75] Inventor: Seiichi Kanemoto, Nagoya, Japan

[73] Assignee: Brother Kogyo Kabushiki Kaisha, Nagoya, Japan

[21] Appl. No.: 804,760

[22] Filed: Dec. 11, 1991

[30] Foreign Application Priority Data

Feb. 8, 1991 [JP] Japan ..... 3-11596[U]

[51] Int. Cl.[5] ..... B41J 2/295

[52] U.S. Cl. ..... 400/124; 400/157.2; 101/93.05

[58] Field of Search ..... 400/124, 157.2, 157.1; 101/93.05

[56] References Cited

U.S. PATENT DOCUMENTS

| | | | |
|---|---|---|---|
| 4,589,786 | 5/1986 | Fukui et al. | 400/124 |
| 4,874,978 | 10/1989 | Sakaida et al. | 400/124 X |
| 4,886,382 | 12/1989 | Oota et al. | 400/124 |
| 4,979,553 | 12/1990 | Yamaguchi et al. | 400/124 |
| 5,005,994 | 4/1991 | Yano | 400/124 |

FOREIGN PATENT DOCUMENTS

| | | | |
|---|---|---|---|
| 57-34979 | 2/1982 | Japan . | |
| 0163668 | 9/1983 | Japan . | |
| 0000969 | 1/1985 | Japan | 400/124 |
| 63-17060 | 1/1988 | Japan . | |
| 0089353 | 4/1988 | Japan | 400/124 |
| 63-312852 | 12/1988 | Japan . | |
| 2-141256 | 5/1990 | Japan . | |
| 2-147348 | 6/1990 | Japan . | |

*Primary Examiner*—Edgar S. Burr
*Assistant Examiner*—Christopher A. Bennett
*Attorney, Agent, or Firm*—Oliff & Berridge

[57] ABSTRACT

Front ends of the frames of a plurality of print units can be supported by a support member. At the rear end of each frame a fitting member having screw holes is attached. A fixing member is provided on the back side of the fitting members. Screws are inserted into screw holes in the fitting members through holes in the fixing member, so that each fitting member is detachable fixed onto the fixing member. Therefore, as occasion demands, one print unit, including the fitting member, can be detached from the unit and exchanged.

20 Claims, 3 Drawing Sheets

PRINTING HEAD HAVING A DISTORTION ELEMENT

BACKGROUND OF THE INVENTION

1. Field of the Invention

The present invention relates to a printing head for a dot impact type printer, and more particularly, to a printing head having a distortion element which drives a print wire.

2. Description of the Related Art

As shown in FIG. 4, in a conventional type of printing head, a plurality of, for example, twenty four print units 2 for projecting print wires 1 forward (in the left in FIG. 4) are arranged to be attached to a circular support member 4 having a nose portion 3. Each of the print units 2 has a frame 5 made of a superinvar alloy. The frame 5 supports a piezoelectric element 6 and transmission mechanism 7. The plurality of print units 2 are circumferentially arranged in an annular shape at the back side of the support member 4. The back side is opposite to the side where a nose portion 3 is provided. The plurality of the print units 2 are attached as follows: a screw 9 is fastened to a nut member 8 fixed at the fore end 5*a* of the frame 5 through a fixing hole 4*a* formed in the periphery of the support member 4. The fore end 5*a* is the end where the transmission mechanism 7 is supported. On the other hand, a rear end 5*b* is the other end where the transmission mechanism 7 is supported. The tip end of the print wire 1 with the base end thereof fixed in the transmission mechanism 7 is adapted to project by a predetermined length through a through hole (not shown) formed at the tip end of the nose portion 3 in vertical arrangement.

With selective application of a voltage to the print unit 2 (i.e., the piezoelectric element 6), the extension of the piezoelectric element 6 can be amplified by the transmission mechanism 7 to be transmitted to the print wire 1. As a result, the print wire 1 at a given position can be projected, thus performing a print operation.

However, in the conventional construction as described above, the frame 5 is only screwed at the fore end 5*a*. Accordingly, the print unit 2 is swung on the screwed portion in the directions indicated by arrows X and Y in FIG. 4 together with the drive of the piezoelectric element 6. Therefore, there are problems inclusive of energy loss of the extension of the piezoelectric element 6, and deterioration in quality of print.

In order to solve the above explained problems, a printing head, in which the rear ends 5*b* of all frames 5 are bonded to a part of disk type member by an adhesive, with the disk type member fixed at the rear ends 5*b* of the frames 5 of the plurality of the print units 2 arranged in an annular shape, has been proposed. According to such printing heads, the plurality to print units 2 are supported by each other at the rear ends 5*b* of the frames 5 thereof, thereby preventing any swing of the frames 5 at the rear ends 5*b* thereof and any generation of vibration.

However, in the printing heads, in which all the print units 2 are fixed integrally by the adhesive as described above, when exchange of only one of the print units 2 is required in the case that one of the print wires 1 happens to be broken, the exchange work is very cumbersome.

Further, related design for fastening the fore end 5*a* and the rear end 5*b* of the frame 5 by screws is disclosed in the Japanese Laid-Open Patent Publication No. 63-312852.

However, there is a problem that the invar alloy constituting the frame 5 of the print unit 2 is difficult to machine. In addition, there is another problem that arises when both ends 5*a*, 5*b* of the frame 5 are fastened by screws. The frame 5 is drawn lengthwise due to a dimensional differences in the lengths of the frames arising from manufacturing tolerances, so that the energy loss of extension of the piezoelectric element 6 is caused. Therefore, the quality of the printing is deteriorated.

SUMMARY OF THE INVENTION

It is therefore an object of the present invention to provide a printing head where a plurality of print units can be assembled without any vibration in order to keep a printing of high quality.

Another object of the present invention is to provide a printing head, wherein only one of a plurality of printing heads can be attached or detached so that each of the print units can be exchanged with ease.

Further, another object of the present invention is to prevent the quality of the printing from deteriorating and to increase the productivity of the printing without the necessity of machining of a screw hole in the frame of the print head.

A printing head having a distortion element comprising: a plurality of print units, each of said print units including a frame, a print wire, a distortion element for driving the print wire and a transmission mechanism for enlarging and transmitting displacement of the distortion element to the print wire, said frame supporting the distortion element and the transmission mechanism; a support member for supporting one end of said frame of said print unit; a plurality of fitting members each fitted to the other end of said frame of said print unit; and a fixing member for supporting said other end of each frame by a plurality of fitting members detachably attached thereto.

According to the above-mentioned construction, each frame of the plural print units is supported at one end thereof by the support member and is secured at the other end thereof to the fixing member through the fitting member. Consequently, the print unit is supported on both sides.

Therefore, the printing head can prevent any swing of the frame of the print unit on the other end at the time of the extension of the piezoelectric element, and moreover, can keep the printing of high quality.

Furthermore, since the fitting members are each provided in the print units and are detachably attached to the fixing member, each one of the print units can be individually attached or detached with ease. That is, each of the print units can be exchanged with ease.

Further, since each of fitting members is fitted on the print unit by engagement, the productivity of the printing can be increased without the necessity of machining of a screw hole in the frame of the print unit.

DETAILED DESCRIPTION OF THE PREFERRED EMBODIMENTS

Figure 1:
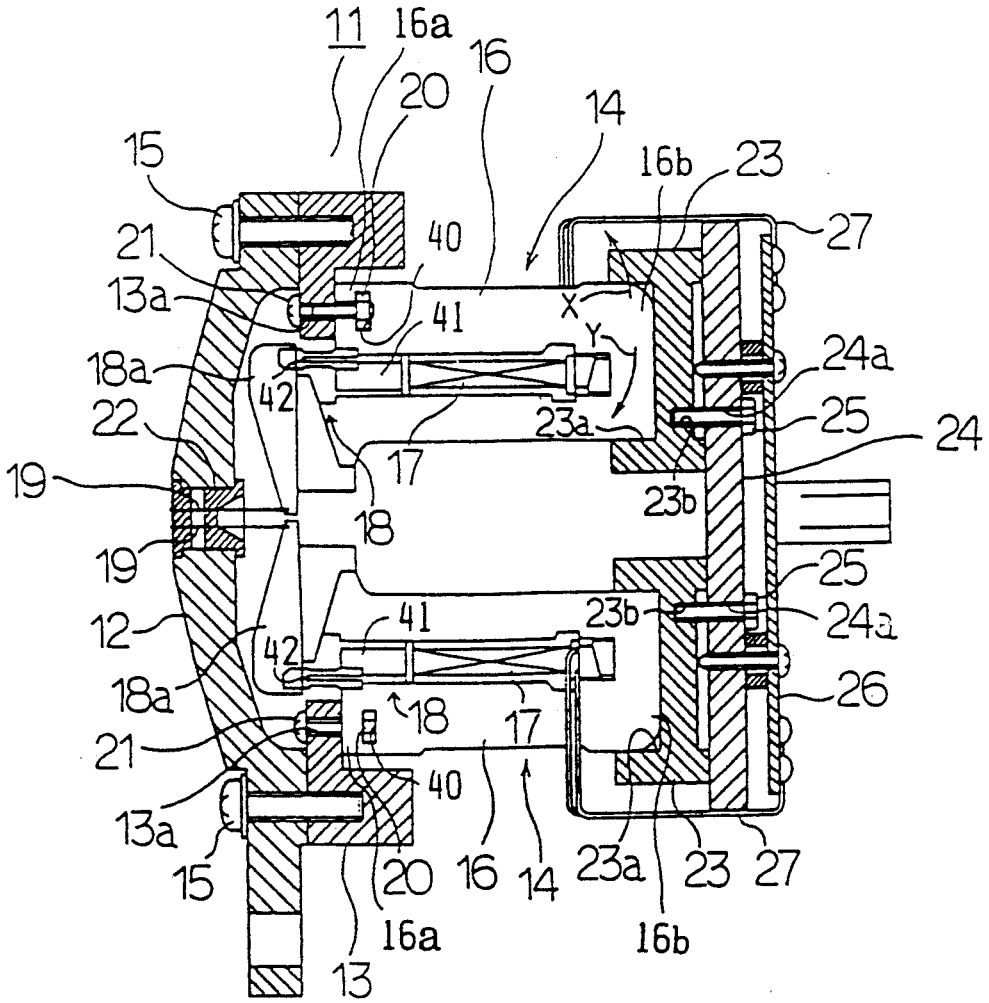
FIG. 1 is a longitudinal sectional side view showing one preferred embodiment according to the invention.

One preferred embodiment according to the invention will be now explained with reference to FIGS. 1 and 2. As shown in FIG. 1, a printing head unit has a plurality of, e.g., twenty four, print units 14 which are attached to a support member 13 having a nose portion 12. The support member 13 is formed into an annular shape, and is provided with twenty four fixing holes 13*a* arranged in the circumferential direction, where the print units 14 are screwed as described later. The nose portion 12 is formed into a conical shape, and is secured to the front surface of the support member 13 by a plurality of screws 15. The nose portion 12 has twenty four through holes (not shown) vertically arranged in the central portion projecting forward.

Figure 2:
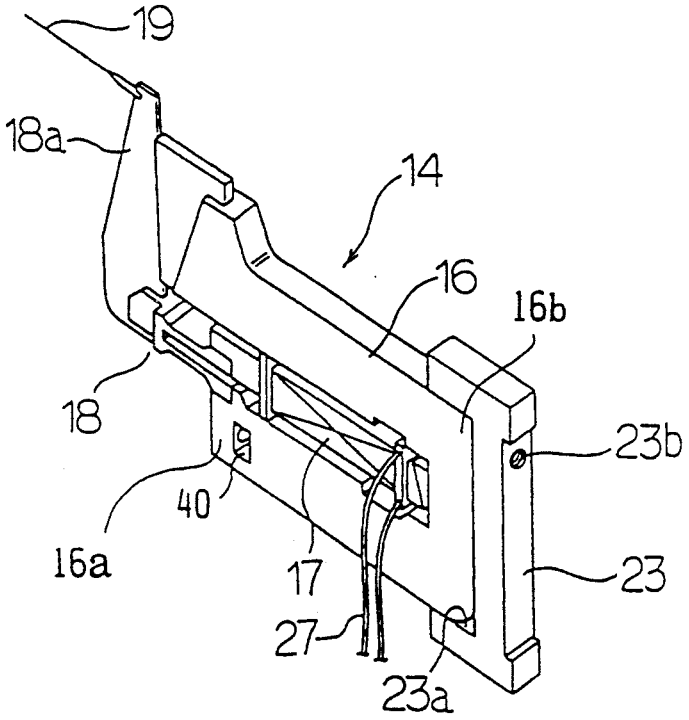
FIG. 2 is a perspective view showing a print unit and a fitting member in the preferred embodiment according to the invention.

In the print unit 14 as illustrated in FIG. 1 and FIG. 2, a ceramic piezoelectric element 17 and a transmission mechanism 18 are supported in a frame 16 made of a superinvar alloy. The frame 16 is formed into a U-shape elongated lengthwise with the opened front end 16*a* where the transmission mechanism 18 is supported. The frame 16 has the piezoelectric element 17 arranged therein and the transmission mechanism 18 disposed at the opened end thereof.

The transmission mechanism 18 comprises a U-shaped eden spring 42 and an arm 18*a* fixed in the frame 16 at one end thereof while fixed in a movable piece 41 capable of moving according to the extension of the piezoelectric element 17 at the other end thereof. The arm 18*a* at the tip end of the transmission mechanism 18 is connected to the base end of a print wire 19. The tip end of the print wire 19 is projected forward by a predetermined length from the nose portion 12 through the through hole of the nose portion 12. As is well known, the piezoelectric element 17 extends lengthwise with application of a voltage. The transmission mechanism 18 is adapted to enlarge or amplify the extension of the piezoelectric element 17 to transmits it to the arm 18*a*, whereby the print wire 19 projects forward. The piezoelectric element 17 contracts when the application of a voltage ceases, to return the print wire 19 to the original position.

At the front end 16*a* of the frame 40 is bored a hole 40 disposed on the side opposed to the arm 18*a* (on the outer peripheral side). A nut member 20 is inserted into the hole 40. A screw 21 is fastened to the nut member 20 through a fixing hole 13*a* of the support member 13 so that the print units 14 are annularly arranged in the circumferential direction at the back side of the support member 13. The back side is the side which is opposite to the nose portion 12. Therefore, the front ends 16*a* of the frames 16 of twenty four print units 14 can be supported by the support member 13. The print wires 19 of the print units 14 are inserted into the respective through hole of the nose portion 12 via a guide plate 22 disposed on the back side in the center of the nose portion 12.

At the rear end 16*b* of the frame 16 of each print unit 14 is attached a fitting member 23 made of aluminum. The rear end 16*b* is the end opposite to the front end 16*a*. As depicted in FIG. 2, the fitting member 23 is provided with a U-shape fit portion 23*a* mating with the width of the frame 16. The fitting member 23 is fitted under pressure onto the rear end of the frame 16 for secure engagement. In addition, on the back side of the fitting member 23 is formed a screw hole 23*b*. The back side is the opposite side of the fit portion 23*a*. One fitting member 23 is independently provided per print unit 14, and twenty four fitting members 23 are fixed on the fixing member 24.

The fixing member 24 is disk-shaped. Twenty four fixing holes 24*a*, mating with the screw holes 23*b* of the fitting members 23, are bored in the plate in an annular arrangement. Screws 25 are inserted into the screw holes 23*b* through the fitting holes 24*a* so that each fitting member 23 is detachably fixed in the fixing member 24 in abutment with the fixing member 24 on the back side thereof. Therefore, the rear ends 16*b* of frames 16 can be mutually supported by the fixing member 24 via the fitting members 23.

As described above, all the print units 14 are fixed on the fixing member 24 via the fitting members 23, before the contact portions between the fitting members 23 and the print units 14 are bonded with an adhesive. Therefore, the elongation of the frames 16 is reduced or eliminated as compared with the print head wherein the fitting members 23 and the print units 14 are directly fastened to each other by screws.

On the back side of the fixing member 24 is screwed a printed circuit board 26. Lead wires 27 introduced from the piezoelectric elements 17 of the print units 14 are connected [to the printed circuit board 26. Although not shown, a cylindrical cover is provided to cover the printing head unit 11 in the peripheral and rear portions thereof. In the printing head unit 11 so constituted as described above, the print wires 19 at the predetermined dot positions project upon selective application of a voltage to the print units 14 (piezoelectric element 17), thereby printing a character to be printed. At the time of the drive of the print units 14, a force generated by the extension of the piezoelectric element 17 acts on the frame 16 to swing it about the screwed portion in the directions indicated by the arrows X and Y in FIG. 1. In this embodiment, however, the frames 16 are supported also at the rear ends thereof by the fixing member 24 via the fitting members 23, to prevent the rear ends of the print units 14 from being swung. Therefore, there is no loss of the energy for projecting the print wire 19 forward.

When one of the print wires 19 is broken, the print unit 14 is exchanged. In this exchange operation, the screws 25 and 21 are detached so that only one print unit 14 to be exchanged including the fitting member 23, has to be detached from the unit and only one new print unit 14 has to be attached.

Figure 4:
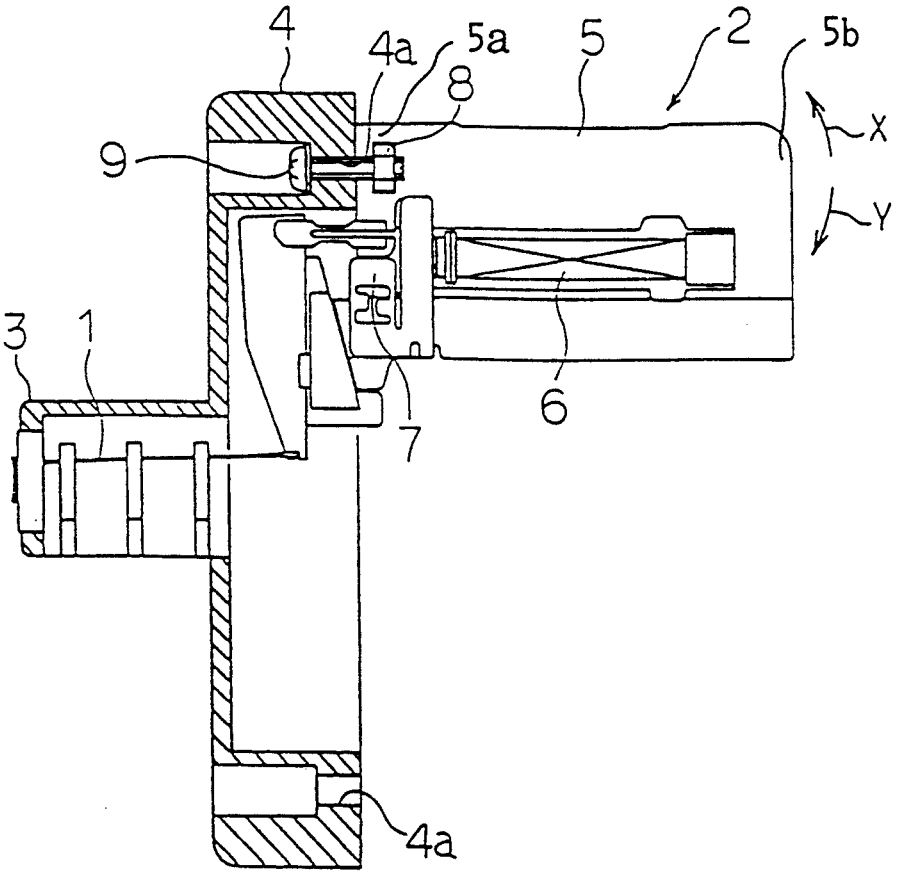
Fig.4 PRIOR ART
FIG. 4 is a longitudinal sectional side view showing a prior art print head.

According to the present invention as explained above, the frames 16 of the plurality of print units 14 are supported at the front ends 16*a* thereof by the support member 13 and at the rear ends 16*b* thereof by the fixing member 24 via the fitting members 23. Consequently, each print unit 14 is supported at both the front and rear ends thereof, which is different from the conventional print head illustrated in FIG. 4 where the frame 5 is mounted at the front end 5*a* only. As a result, the print unit 14 can be assembled in a manner which inhibits vibration, and a preferable print quality can be secured.

In the present embodiment, different also from the conventional unit where the rear ends 16*b* of the frames 16 of all the print units 14 are bonded to the disk type member by the adhesive, in individual print unit 14 can be attached or detached with ease, thus facilitating the exchange of each print unit.

In order to detachably support the rear ends of the plurality of print units 14 to the fixing member 24, the screw holes are bored at the rear ends 16*b* of the frames 16 so that the print units 14 may be directly screwed in the fixing member 24 not using the fitting members 23. However, if the frame 16 is screwed at both the fore and rear ends, the frame 16 by itself is extended by the fastening force, causing a lower print quality due to deterioration in dimensional accuracy. Furthermore, for the purpose of prevention of reduced print quality induced by adverse effect of thermal expansion and contraction, a superinvar alloy having a very low thermal expansion coefficient is used for the frame 16. Consequently, screw hole machining in the frame 16 is difficult, and productivity becomes very low.

In this embodiment contrary to the conventional unit described above, the rear end 16*b* of the frame 16 is supported by the fixing member 24 via the fitting member 23 made of material relatively easy to be machined. As a result, the frame 16 cannot be extended, and productivity is improved because the necessity for screw hole machining with respect to the frame 16 is eliminated.

Figure 3:
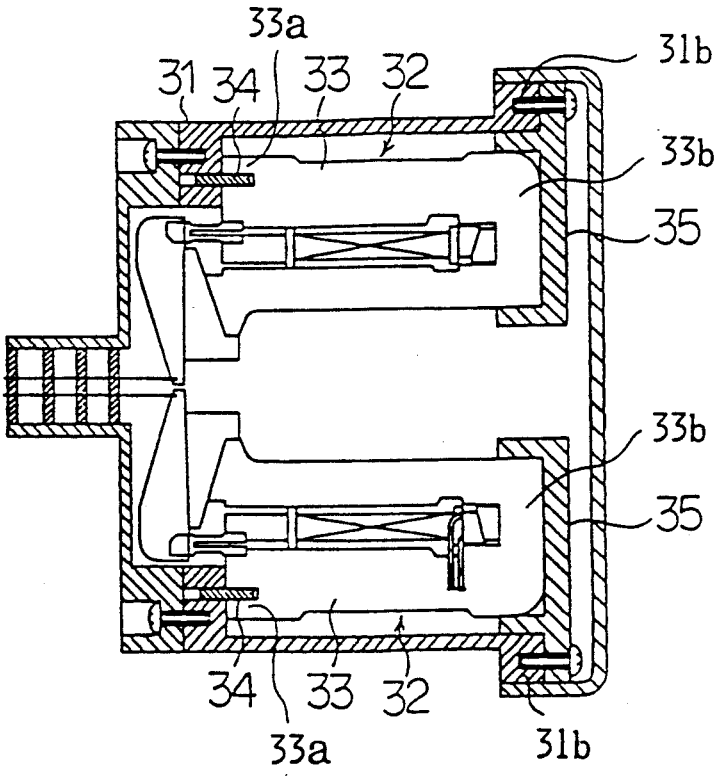
FIG. 3 is a longitudinal sectional side view showing another preferred embodiment of the invention.

Another embodiment according to the present invention is illustrated in FIG. 3. In this embodiment, a support member 31 is formed into a cylindrical shape. The front end 33*a* of the frame 33 of a print unit 32 is supported by a pin 34. A fitting member 35 fitted at the rear end 33*b* of the frame 33 is screwed onto the rear end of the support member 31. In this case, the support member 31 also functions as the fixing member according to the invention. With the constitution, the same effect as the aforementioned embodiment can be attained.

The present invention is not limited to the above described embodiments. For example, the frame 16 may be bonded to the fitting member 23, and the fitting member may be formed of various materials in other shapes without departing from the spirit or scope of the present invention.

Besides, the piezoelectric element 17 as the distortion element is described in the present embodiment. However, according to the invention, for instance, a magnetostriction element which is distorted by the effect from the outside can be used.

What is claimed is:

1. A printing head comprising:

a plurality of print units, each of said print units including a print wire, a distortion element for driving the print wire, a transmission mechanism for amplifying and transmitting displacement of the distortion element to the print wire, and a frame having a front end near the print wire and a rear end opposite to the front end said frame supporting the distortion element and the transmission mechanism;

a support member for supporting the front end of the frame of each print unit;

a plurality of screws each of which rigidly fixes the front end of one of the frames to the support member;

a plurality of separate fitting members, one of the plurality of fitting members being fitted to the rear end of an associated one of said frames; and a fixing member supporting the rear ends of the frames of said plurality of print units by means of said plurality of fitting members being detachably attached to said fixing member.

2. The printing head according to claim 1, wherein each of said fitting members includes a fit portion mating with the frame, said first portions being fitted at said rear end of each frame.

3. The printing head according to clam 2, wherein each fitting member includes a screw hole located on a side of the fitting member which is opposite to said fit portion.

4. The printing head according to claim 3, further comprising a plurality of screws, wherein said fixing member is mounted on the side of said fitting members on which said screw hole is located, said fixing member having a plurality of fixing holes, each fixing hole mating with one of the screw holes, wherein said screws are inserted into the screw holes through the fixing holes so that each of said fitting members is detachably fixed on said fixing member.

5. The printing head according to claim 4, wherein said fixing member is disk shaped and the fixing holes are in an annular arrangement on said fixing member.

6. The printing head according to claim 2, further comprising an adhesive, said adhesive fixing said fit portion of each said fitting member to said rear end of said associated frame.

7. A printing head comprising:

a plurality of print units, each of said print units including a print wire, a distortion element for driving the print wire, a transmission mechanism for amplifying and transmitting displacement of the distortion element to the print wire, and a frame having a front end near the print wire and a rear end opposite the front end, said frame supporting the distortion element and the transmission mechanism;

a nose portion;

a support member mounted on the nose portion, for supporting the front end of each frame adjacent the nose portion;

a plurality of pins each of which rigidly fixes the front end of one of the frames to the support member; and a plurality of fitting members detachably fixed on said support member, one of the plurality of said fitting members being fitted to and supporting the rear end of an associated one of said frames.

8. The printing head according to claim 7, wherein said support member is cylindrical.

9. The printing head according to claim 7, wherein each frame has a bore at the front end;

the support member has a plurality of bores formed therein, each bore in the support member being aligned with the bore of one frame; and one pin of the plurality of pins extends between each one of the aligned bores of the support member and each frame to support the front end of each frame on the support member.

10. A printing head comprising:

a plurality of print units, each of said print units including a print wire, a distortion element for driving the print wire, a transmission mechanism for amplifying and transmitting displacement of the distortion element to the print wire, and a frame having front end near the pin wire and a rear end opposite to the front end, said frame supporting the distortion element and the transmission mechanism;

a support member for supporting the front end of the frame of each print unit;

a plurality of fasteners each of which rigidly fixes the front end of one of the frames to the support member;

a plurality of fitting members, one of the plurality of fitting members being fitted to the rear end of an associated one of said frames opposite to the first end; and mounting means for supporting the rear end of each frame, said plurality of fitting members being detachably attached to said mounting means.

11. The printing head according to claim 10, wherein each of said fitting members includes a fit portion mating with the associated frame said fit portion being fitted at said rear end of the frame.

12. The printing head according to claim 11, further comprising an adhesive, said adhesive fixing said fit portion of each said fitting member to said rear end of said associated frame.

13. The printing head according to clam 10, wherein said mounting means comprises a plate, each of the fitting members being detachably mounted on the plate.

14. The printing head according to claim 12, wherein each of said fitting members includes a screw hole located on a side of the fitting member which is opposite to said fit portion.

15. The printing head according to claim 14, further comprising a plurality of fasteners, wherein said mounting means is mounted on the side of said fitting members on which said screw hole is located, said mounting means having a plurality of mounting holes, each mounting hole mating with the screw hole of one of said fitting members, and a one of said fasteners is inserted into each screw hole through one of the mounting holes so that each of said fitting members is detachably mounted on said mounting means.

16. The printing head according to claim 15, wherein said mounting means is disk shaped and the mounting holes are in an annular arrangement on said mounting means.

17. The printing head according to claim 10, wherein said mounting means is integral with the support member.

18. The printing head according to claim 17, wherein said support member is cylindrical.

19. The printing head according to claim 18, wherein said plurality of fasteners comprises a plurality of pins;

each frame has a bore at the front end;

the support member has a plurality of bores formed therein, each bore in the support member being aligned with the bore of one of the frames; and one pin of the plurality of pins extends between each bore of the support member and the aligned bore of one of the frames to support the front end of each frame on the support member.

20. The printing head according to claim 17, further comprising an adhesive, wherein each of said fitting members includes a fit portion mating with said rear end of the associated frame, said fit portion being is fixed to said rear end of the associated frame using said adhesive.

* * * * *